US007335172B2

(12) United States Patent
Laserow

(10) Patent No.: US 7,335,172 B2
(45) Date of Patent: Feb. 26, 2008

(54) BALANCING AND EXERCISING DEVICE WITH VIBRATOR

(75) Inventor: Kaj Laserow, Malmö (SE)

(73) Assignee: Promedvi AB, Lund (SE)

( * ) Notice: Subject to any disclaimer, the term of this patent is extended or adjusted under 35 U.S.C. 154(b) by 241 days.

(21) Appl. No.: 10/997,108

(22) Filed: Nov. 24, 2004

(65) Prior Publication Data

US 2005/0148431 A1 Jul. 7, 2005

(30) Foreign Application Priority Data

Nov. 27, 2003 (SE) ..... 0303170
Dec. 30, 2003 (EP) ..... 03445151

(51) Int. Cl.
*A61H 1/00* (2006.01)
*A63B 23/08* (2006.01)

(52) U.S. Cl. ..... 601/30; 601/27; 601/49; 482/146

(58) Field of Classification Search ..... 601/23, 601/24, 26–29, 30–32, 42, 46, 49, 56–58, 601/60, 65, 67, 69, 70, 84–87, 89, 90, 91, 601/93; 482/79, 80, 146
See application file for complete search history.

(56) References Cited

U.S. PATENT DOCUMENTS

| | | | | |
|---|---|---|---|---|
| 4,848,742 | A | 7/1989 | Lindley et al. | |
| 5,713,820 | A | 2/1998 | Carbone | |
| 5,810,703 | A * | 9/1998 | Stack | 482/146 |
| 5,897,464 | A | 4/1999 | Mcleod | |
| 6,019,712 | A * | 2/2000 | Duncan | 482/146 |
| 7,137,938 | B2 * | 11/2006 | Gottlieb | 482/146 |

FOREIGN PATENT DOCUMENTS

| | | |
|---|---|---|
| DE | 2945308 | 5/1981 |
| DE | 2952634 | 7/1981 |
| FR | 1273567 | 10/1961 |
| FR | 2663855 | 1/1992 |

* cited by examiner

*Primary Examiner*—Quang D. Thanh
(74) *Attorney, Agent, or Firm*—Ladas & Parry LLP

(57) ABSTRACT

The present invention relates to a device for improving and developing the strength, coordination, balancing and proprioception of a user. Especially the present invention relates to an exercising device (10) comprising a balancing means (12) and a vibration means arranged to vibrate said balancing means (12).

17 Claims, 5 Drawing Sheets

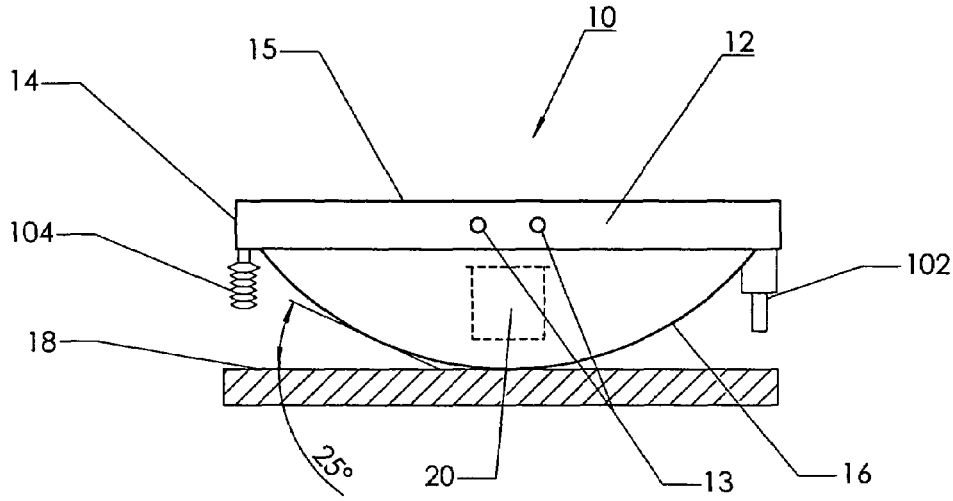
FIG 1
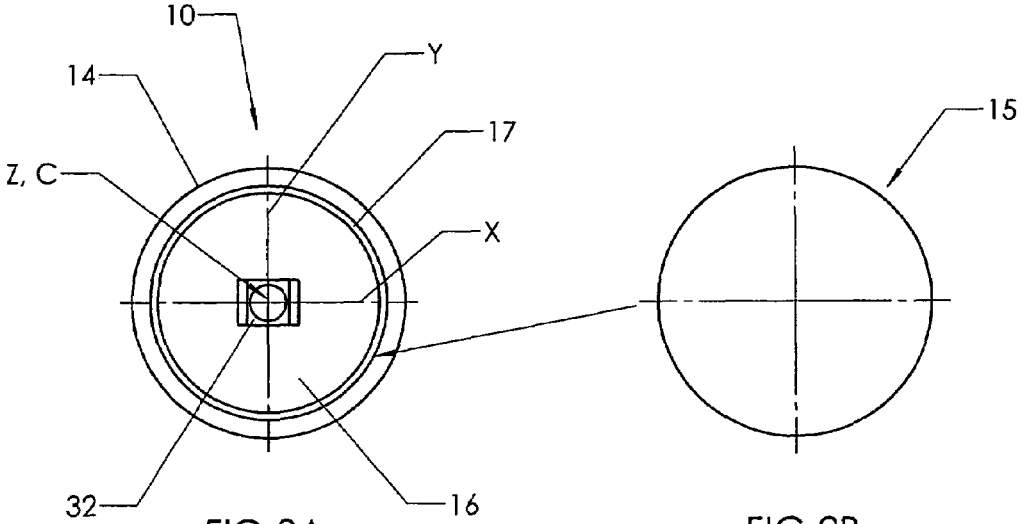
FIG 2A
FIG 2B

BALANCING AND EXERCISING DEVICE WITH VIBRATOR

TECHNICAL FIELD OF THE INVENTION

The present invention relates to a device for improving and developing the strength, coordination, balance and proprioception of a user. Especially the present invention relates to an exercising device comprising a combination of balancing means and vibration means.

BACKGROUND OF THE INVENTION

Development of a good sense of balance, proprioception and coordination is usually a matter of practice. Many sports activities require a user to develop a well developed sense of proprioception or body awareness, including balance, in order to become proficient.

Further, people of the society of today have sometimes problems with dizziness, and strains and injuries of joints and muscles. In order to overcome these problems and to improve a user's motor skills different kinds of balancing boards are commonly used. Many prior art balancing boards comprises a platform for supporting a user and that is pivotable around a single axis. Other prior art balancing boards comprises a hemispherical pivot point, whereby movement in all directions is provided. By standing on the balancing board a user can improve his balance, proprioception, strength and coordination.

The research study "Postural and symptomatic improvement after physiotherapy in patens with dizziness of suspected cervical origin", Arch. Phys. Med. Rehabil. 1996; 77:874-82, shows that vibration-induced body sway is larger for people suffering from dizziness of suspected cervical origin as compared to a healthy control group. This indicates that the postural control is impaired in people suffering from dizziness of suspected cervical origin and suggests that the cervical disorders may affect the human balance function. The study also discloses that physiotherapy, e.g. soft tissue treatment, stabilization exercises of the trunk and cervical spine, passive and active mobilization, relaxation techniques, home training programs and minor ergonomic changes, aimed to decrease cervical discomfort, objectively improved the distributed postural performance and reduced the subjective symptoms of dizziness and neck pain.

The inventor of the present invention has realized that a combination of balancing and vibration induced training can be used to improve the strength, coordination, balance and proprioception of a trainer. Further, the present inventor has realized that such a combined training would result in a training that is quicker, improved and more effective as compared to the training using a conventional balancing board.

However, as far as known to the present inventor, research on such a combined balancing and vibration induced training does not exist today and no combined balancing and vibration device is available today.

Thus it is an object of the present invention to provide such an exercising device comprising both balancing means and vibration means, whereby the balancing training is improved as compared to conventional balancing boards.

An aspect of the invention is to stimulate and activate different senses, groups of muscles and receptors susceptibility, whereby the effect of the training is increased and the result of the training is improved.

Another aspect of the invention is to increase the stability of the joints of a user, whereby a more efficient training or rehabilitation is obtained.

SUMMARY OF THE INVENTION

The object and aspects described above amongst others are obtained by a device according to the accompanying independent claim. Embodiments of the invention are defined in the dependent claims.

The exercising device according to the invention is designed to improve and develop the strength, coordination, balance and proprioception of a user.

Further, the exercising device according the invention is constructed to give optimal training for e.g. patients and athletics having injuries after distortions and fractures but also to other injuries affecting the balance capability of the patient, such as dizziness due to a Whiplash injury after a traffic accident.

By means of the vibrations the susceptibility of different senses, muscles groups and receptors is increased, whereby the effect and the result of the balancing training are improved. The vestibule-ocular reflex will also be stimulated, whereby the balancing training will be more effective.

Further, the vibrations give an increased activation and stimulation of muscle groups and tendons located around ligaments, whereby the sensory bodies in ligaments are stimulated and the joint is stabilized. The stabilization of the joint implies that the exercise centralizes the joint, which gives an optimal function of the joint. This can for example be seen at training of pectoralis or deltoideus using e.g. dumbbells. In the beginning of the training it will be difficult to obtain a linear movement. However, after some training it will be easy to obtain the linear movement due to the centralization of the joint.

BRIEF DESCRIPTION OF THE DRAWINGS

The present invention will be described in more detail with reference to the accompanying drawings, in which:

FIG. 1 is a side view of a first embodiment of the exercising device according to the invention;

FIGS. 2A and 2B schematically show views taken from above of a platform and a base contacting member of the exercising device of FIG. 1 with a plate of the balancing means removed, and a plate of the exercising device of FIG. 1, respectively;

DETAILED DESCRIPTION OF THE INVENTION

Figure 3A:
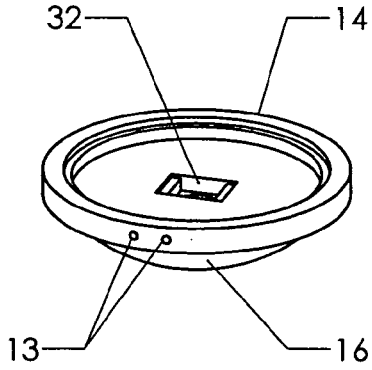
FIGS. 3A and 3B schematically show perspective views of the solid base contacting member of FIG. 2A and a hollow base contacting member having reinforcement means, respectively.

The present invention will now be described in more detail by reference to the accompanying drawings in which the same reference numerals indicate the same or similar components. It should be understood that the described embodiments of the invention are not intended to limit the scope of the present invention, but only to illustrate the invention. Further, modifications can be made without falling outside the scope of the invention.

FIG. 1 schematically shows a cross-sectional view of a first embodiment of the exercising device 10 according to the invention. The exercising device 10 comprises a balancing means 12 and a vibration means 20 arranged to vibrate the balancing means 12. The vibration means 20 is arranged to provide horizontally and/or vertically directed vibrations of the balancing means 12. The balancing means 12 comprises a plate 15 configured to support at least a body part of a user (cf. FIGS. 2A and 2B). For example the plate 15 can be configured to support the feet of a user standing on the exercising device 10. The plate 15 can be exchangeable arranged at a platform 14 of a base contacting member 16, whereby the plate can be exchanged for a soft or jelly-like plate, which gives the user a more uncontrolled feeling when balancing, or an angled plate or platform. Thus, the degree of exercise can be varied in many ways.

The balancing means 12 comprises a base contacting member 16 having a substantially semicircular or an elliptic cross-section and configured to provide a pivoting motion of said exercising device 10. The base contacting member 16 is preferably configured to accommodate a two dimensional pivoting motion, that is a pivoting motion in any direction in the space defined by the pivot axes X and Y shown in FIG. 2A. Thus the exercising device 10 can be pivoting in several directions and it is not necessary that the balancing is performed in a direction around one of the pivot axes but the balancing can also be performed in a circular motion around the centre C of the exercising device, that is a pivoting motion in a direction around the pivot axis Z shown in FIG. 2A. The base contacting member 16 can for example have a hemispherical or an ellipsoidal shape providing a tilting movement in all directions around a pivot point. According to this embodiment, the base contacting member 16 is configured to maintain the exercising device 10 in a fixed position and orientation with respect to a base surface 18. For example, the base contacting member 16 can be manufactured of a material providing a sufficient friction against a base surface 18 to prevent the exercising device 10 from gliding over the base surface 18. The base surface can for example be the ground, a floor, a carpet or a mattress.

According to one embodiment of the invention, the base surface is configured as a mattress 18 manufactured of an elastic material, e.g. a jelly-like material or a foam rubber material, whereby the mattress shapes itself to the shape of the exercising device when the exercising device is placed on the mattress. Thus, dependent on i.e. the choice of material and the thickness of the mattress, the mattress can function as a support to the exercising device, whereby the pivoting motion of the exercising device can be varied. By replacing a mattress with a less supportive mattress, the pivoting motion is increased and thereby the difficult of the exercise.

The balancing means 12 further comprises a platform 14 arranged at an upper part of the base contacting member 16. The platform 14 is for example tubular and has a cylindrical shape, and configured to support the plate 15. The outer diameter of the platform is usually in the range of approximately 360-400 mm.

The distance between the upper edge of the platform 14 and the base surface 18 is for example less than 150 mm and the angle between the base surface 18 and the platform 14 in tilted position is less than 25 degrees.

The given dimensions and measures can however be varied in order to vary the degree of difficulty of the training.

FIG. 2A is a schematic view taken from above of a platform 14 and a base contacting member 16 of the exercising device 10 of FIG. 1 with the plate 15 removed. As shown in the figure, the base contacting member 16 has a recess 32, e.g. a central rectangular recess, configured to retain a part of the vibration means 20. The platform 14 has at its upper edge along its inner circumference a recess 17 arranged to support the plate 15. The outer edge of the plate can for example rest on the recess or the plate can be provided with a circular protrusion (not shown) dimensioned to fit in the recess, whereby the plate in the latter case can have a diameter that is larger than the diameter of the platform.

FIG. 2B shows a schematic view taken from above of the plate 15 of the exercising device 10 of FIG. 1. As mentioned above the plate is arranged to support a body part of a user and can for example be provided with a groove pattern (not shown) or a rough surface in order to e.g. prevent the feet of the user to slide over the plate when the user is standing on the exercising device.

Figure 3B:
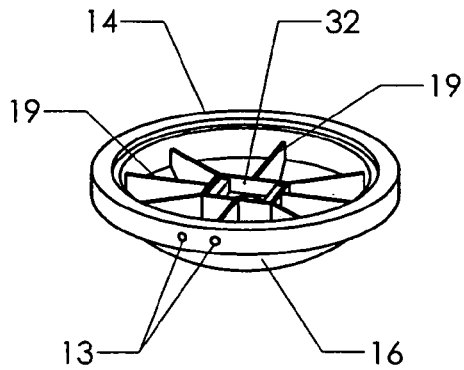

FIGS. 3A and 3B show perspective views of the platform 14 and the base contacting member 16. The recess 32 for the vibration means is also shown. Further, FIG. 3A schematically illustrates a solid base contacting member 16 and FIG. 3B schematically illustrates a hollow base contacting member 16 having reinforcement means 19 extending from the container walls defining the recess 32 for the vibration means 20 to the inner surfaces of the base contacting member 16 and the platform 14. The platform 14 is further provided with holes 13 for electric cables or an electric socket.

The exercising device according to the invention can also comprise a balancing means provided with one or several supports 102 (FIG. 1) arranged to limit the pivoting motion of the exercising device in one or several directions. The support can for example be constituted of a cushioning, air bellows or an air collar 104 which e.g. can be lowered from the upper part of the exercising, device towards the base surface.

The exercising device or the mattress can be configured with means arranged to provide one or several pushes or shocks to the part of the exercising device supporting the user, whereby the degree of difficulty is increased and whereby the user improves his balancing skills by counterbalancing the push.

Figure 4:
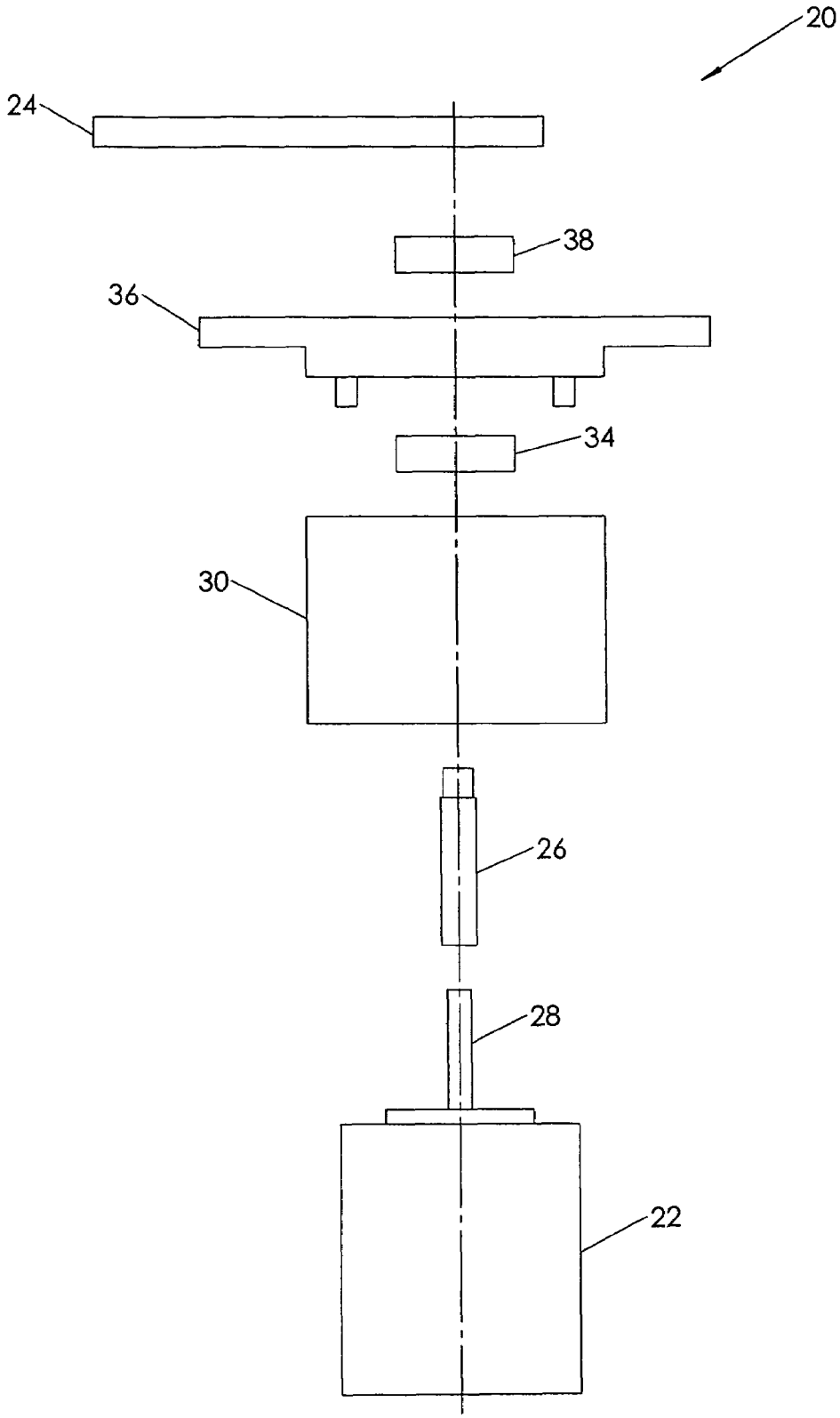
FIG. 4 schematically shows an exploded view of a vibration means according to the invention.

FIG. 4 shows an exploded view of parts of the vibration means 20. The vibration means 20 comprises an electric motor 22 arranged to rotate an eccentrically arranged load 24, whereby the rotation of said load 24 gives rise to said vibration of said balancing means 12.

The vibration means 20 is configured to provide vibrations having frequencies above 0 Hz, preferably in the interval of approximately 0-100 Hz and usually in the interval of approximately 20-100 Hz, whereby the receptors of the body part to be trained, e.g. the foot, the calf and the neck, are stimulated.

The vibration means can be configured to provide vibrations starting at a central or inner part of the balancing means and then propagate outwards.

The load 24 is connected to the motor 22 by means of a shaft 26 having a diameter larger than the diameter of the shaft 28 of the motor 22. The motor 22 is rigidly arranged at a first fixation means 30, e.g. a solid metal piece. The first fixation means 30 is fitted in the recess 32 in the interior of the balancing means 12, which recess 32 has dimensions adapted to the dimensions of the first fixation means 30. By this arrangement the vibrations of the motor, during operation of the vibrations means, is eliminated or reduced, whereby the risk of damaging the motor is also eliminated or reduced.

Further, a first bearing 34, e.g. a ball bearing, is arranged at the shaft 26 between the first fixation means 30 and a second fixation means 36, e.g. a metal piece, and a second bearing 38 is arranged at the shaft 26 between the second fixation means 36 and the load 24. The bearings 34, 38 are arranged to take up the forces radially in order to stabilize the shaft 26 and not to load the motor 22. When the vibration means 20 is mounted in the recess 32 of the balancing means 12, the second fixation means 36 can also be fitted in the recess 32.

It should be understood that the vibrations can be accomplished by means of another type of vibration means. For example, the shaft of the motor can be arranged to directly rotate the eccentric load or the shaft of the motor can, by means of a belt or gear wheels, be arranged to drive another shaft which rotates the eccentric load.

Figure 5:
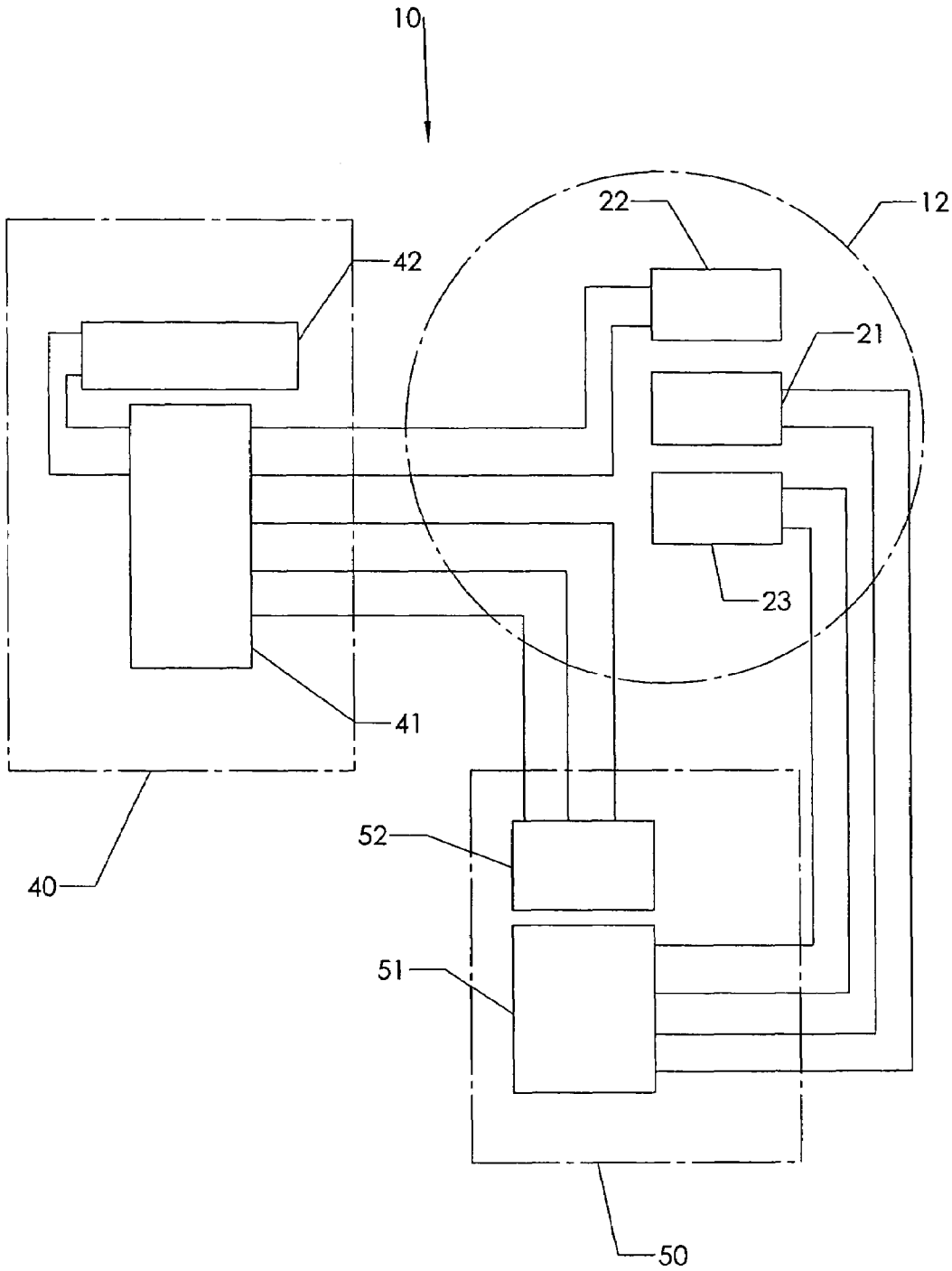
FIG. 5 schematically shows a circuit diagram of the exercising device according to FIG. 1.

FIG. 5 shows schematically a circuit diagram of one embodiment of the exercising device 10 according to FIG. 1. As indicated in the figure, the exercising device 10 comprises a balancing means 12, a power supply 40 and a control means 50. Further, the balancing means 12 comprises a motor 22 connected to a printed circuit card 41 of the power supply 40, a light source 21 configure to emit light towards the shaft of the motor, a reflector (not shown) arranged at the shaft of the motor configured to reflect the emitted light once per revolution, and a detector 23 configured to detect the emitted light and measure the number of revolutions per minute of the shaft. The light source 21 and the detector 23 are connected to a power supply 51 of the control means 50. The printed circuit card 41 of power supply 40 is connected to a transformer 42 also comprised in the power supply 40. The control means 50 comprises the power supply 51, e.g. realized as a battery, and an interactive device 52 connected to the printed circuit card 41. The interactive device 52 comprises a display means (not shown) configured to display the measured number of revolution per minute and a potentiometer (not shown) or the like by means of which a user can set a desired number of revolutions per minute. Thus, by means of the control means 50 communicatively connected to said motor 22 the rotational speed of said motor 22 can be controlled, whereby the frequency of the vibrations can be adjusted. The control means can for example be realized as a handheld control unit such as a remote control.

Figure 6:
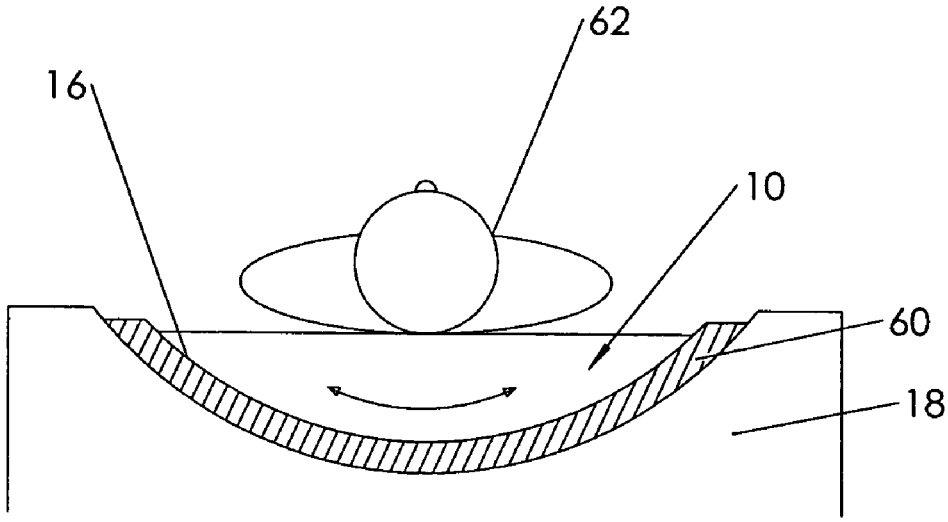
FIG. 6 schematically shows a cross-sectional view of a second embodiment of the exercising device according to the invention.

FIG. 6 shows a cross-sectional view of a second embodiment of the exercising device according to the present invention. In the figure a user 62 is lying down on the exercising device 10. In this embodiment, the exercising device 10 is configured to fit in a chair or a bed, whereby exercising can be accomplished while sitting or lying down. The base contacting member 16 is configured to provide a pivoting movement of the exercising device 10 by sliding over a base surface 18, e.g. a frame. In FIG. 6 the direction of the sliding movement is indicated by an arrow. In order to improve the sliding motion of said base contacting member 16 and thereby increase the balancing exercise, a means for providing a sliding movement 60 can be arranged between the base contacting member 16 and the base surface 18. The sliding means 60 can for example be constituted of a mattress having a smooth surface on which the base contacting member 16 easily can slide.

In the figures the shown exercising device has hemispherical base contacting member and circular platform and plate. However, the dimensions and the shape of the exercising device can be varied in many ways and it should be understood that the shape of the base contacting member, the platform and plate also can be modified in different ways without falling outside the scope of the present invention. For example, the platform and the plate can be rectangular, quadratic or oval, but they can also have other suitable shapes or combinations of the above mentioned. The base contacting member is suitably designed to provide pivoting movements in several directions around a fulcrum. The base contacting member can for example have a hemispherical or an ellipsoidal shape having a semicircular or an elliptic cross-section. The exercising device can also comprise means for determining and displaying the degree of tilting of the exercising device. Further, the exercising device can be configured vertical adjustable whereby the degree of difficult of the exercise can be varied by varying the distance between the plate and a base surface.

The exercising device according to the invention can also be configured with one or several brushes at the plate, i.e. at the upper part supporting the user. The brushes can be configured for tactile stimulation .of the proprioception of the user. The stimulation can for example be accomplished by a movement of the brushes, e.g. an oscillating movement or a rotating movement. The movement of the brushes is preferably accomplished by one or several shafts connected to the motor.

The exercising device according to the invention can also comprise means for simulating a virtual reality to a user. In such an embodiment, display means, e.g. glasses or the like, can display different surroundings to the user, whereby the user will get the feeling of e.g. walking in the mountains or on a golf course. Further, the exercising device is configured to simulate the pattern of the ground of the surroundings, whereby a user will experience height differences and irregularities of the surroundings.

The invention claimed is:

1. An exercising device comprising:

a balancing means, and a vibration means arranged to vibrate said balancing means, wherein said balancing means is designed to provide a pivoting motion of said exercising device around more than one pivot axis, wherein said vibration means comprises a motor rigidly arranged in said vibration means, and arranged to rotate an eccentrically arranged load, whereby the rotation of said load gives rise to said vibration of said balancing means, wherein said vibration means is configured to provide vibrations having a frequency in the interval of approximately 0-100 Hz, whereby the receptors of a body part of a user is stimulated, and muscle groups and tendons located around ligaments are stimulated and activated; and wherein said balancing means is provided with one or several supports arranged to limit the pivoting motion of said exercising device in one or several directions.

2. The exercising device according to claim 1, wherein said balancing means comprises a base contacting member having a substantially semicircular or elliptic cross-section and configured to provide said pivoting motion of said exercising device over a base surface.

3. The exercising device according to claim 2, wherein said balancing means comprises a cylindrical platform arranged at an upper part of said base contacting member and a plate exchangeable arranged at said platform and configured to support at least a body part of a user.

4. The exercising device according to claim 3, wherein said plate can be exchanged with a soft plate, whereby the degree of difficulty of the exercise can be varied.

5. The exercising device according to claim 3, wherein said platform at its upper edge along its inner circumference is provided with a recess arranged to support said plate.

6. The exercising device according to claim 2, wherein said base contacting member is configured to maintain the exercising device in a fixed position and orientation with respect to said base surface.

7. The exercising device according to claim 6, wherein the distance between an upper edge of a platform and said base surface is less than 150 mm and in that the angle between said base surface and said platform in tilted position is less than 25 degrees.

8. The exercising device according to the claim 6, wherein said base surface is configured as a mattress manufactured of an elastic material and configured to shape itself to the shape of said exercising device when said exercising device is placed on said mattress.

9. The exercising device according to claim 2, wherein said base contacting member is configured to provide said pivoting motion of said exercising device by sliding over said base surface and in that an upper part of said exercising device is configured to support at least a body part of a user.

10. The exercising device according to claim 9, further comprising a means for providing a sliding movement is arranged between said base contacting member and said base surface in order to improve the sliding motion of said base contacting member.

11. The exercising device according to claim 10, wherein said means for providing a sliding movement is constituted of a mattress having a smooth surface on which said base contacting member can slide.

12. The exercising device according to claim 10, wherein said exercising device is configured to fit in a chair or a bed, whereby exercising can be accomplished while sitting or lying down.

13. The exercising device according to claim 1, wherein said vibration means is arranged to provide horizontally and/or vertically directed vibrations of said balancing means.

14. The exercising device according to claim 1, wherein said load is connected to said motor by means of a first shaft, in that a plurality of bearings are arranged at said first shaft to take up the forces radially in order to stabilize said first shaft and not to load said motor, when said motor is in operation.

15. The exercising device according to claim 14, wherein said first shaft has a diameter larger than the diameter of a second shaft of said motor, in that said motor is rigidly arranged in a first fixation means, which first fixation means is fitted in a recess in the interior of said balancing means, said recess having the dimensions corresponding to the dimensions of said first fixation means, in that a first bearing is arranged at said first shaft between said first fixation means and a second fixation means, and in that a second bearing is arranged at said first shaft between said second fixation means and said load.

16. The exercising device according to claim 15, further comprising a control means communicatively connected to said motor and configured to control the rotation speed of said motor, whereby the frequency of the vibrations can be adjusted.

17. The exercising device according to claim 1, wherein said one or several supports are constituted of at least one cushioning, air bellow or air collar.

* * * * *